US006001528A

United States Patent [19]

Nagai et al.

[11] Patent Number: 6,001,528

[45] Date of Patent: Dec. 14, 1999

[54] PRODUCTION METHOD OF TONER FOR ELECTROPHOTOGRAPHY

[75] Inventors: Yasuki Nagai, Kobe; Junji Machida, Toyonaka, both of Japan

[73] Assignee: Minolta Co., Ltd., Osaka, Japan

[21] Appl. No.: 09/262,001

[22] Filed: Mar. 4, 1999

[30] Foreign Application Priority Data

Mar. 6, 1998 [JP] Japan ..... 10-054903
Mar. 6, 1998 [JP] Japan ..... 10-054906

[51] Int. Cl.[6] ..... G03G 9/087
[52] U.S. Cl. ..... 430/137
[58] Field of Search ..... 430/137

[56] References Cited

U.S. PATENT DOCUMENTS

| | | | |
|---|---|---|---|
| 4,973,439 | 11/1990 | Chang et al. | 264/142 |
| 5,370,964 | 12/1994 | Patel et al. | 430/137 |
| 5,476,744 | 12/1995 | Anno | 430/137 |
| 5,547,794 | 8/1996 | Demizu et al. | 430/106 |
| 5,593,807 | 1/1997 | Sacripante et al. | 430/137 |
| 5,604,067 | 2/1997 | Nagai et al. | 430/106.6 |
| 5,620,826 | 4/1997 | Tavernier et al. | 430/137 |
| 5,622,802 | 4/1997 | Demizu et al. | 430/106 |
| 5,660,965 | 8/1997 | Mychajlowskij et al. | 430/137 |

FOREIGN PATENT DOCUMENTS

| | | |
|---|---|---|
| 61-91666 | 5/1986 | Japan . |
| 63-25664 | 2/1988 | Japan . |
| 3-15078 | 1/1991 | Japan . |
| 4-78863 | 3/1992 | Japan . |
| 4-178654 | 6/1992 | Japan . |

*Primary Examiner*—Roland Martin
*Attorney, Agent, or Firm*—Burns, Doane, Swecker & Mathis, LLP

[57] ABSTRACT

The present invention relates to a process for preparing a toner for electrophotography, which comprises at least the steps of: providing a toner composition solution by mixing a binder resin, a colorant, a charge-control agent and an organic solvent; mixing the resulting toner composition solution with a dispersion solution containing a dispersing agent by utilizing a collision shearing force of beads or using a colloid mill method, thereby obtaining an O/W type emulsion; heating the resulting emulsion so as to eliminate said organic solvent; and obtaining a toner by washing and drying precipitated particles, wherein a viscosity $\eta_Z$ of the toner composition solution and a viscosity $\eta_B$ of the dispersion solution satisfies a specified the relationship between $\eta_A$ and $\eta_B$.

20 Claims, 7 Drawing Sheets

PRODUCTION METHOD OF TONER FOR ELECTROPHOTOGRAPHY

This application is based on applications No. Hei 10-54903 and Hei 10-54906 filed in Japan, the contents of which are hereby incorporated by reference.

BACKGROUND OF THE INVENTION

1. Field of the Invention

The present invention relates to a process for the production of a toner for electrophotography.

2. Description of the Prior Art

Toners used for electrophotography have been minimized in their particle size so as to meet the recent demand for high precision images, and is generally obtained as fine particles having an average particle size ranging 1 to 10 $\mu$m. With respect to processes for the preparation of such particles, the so-called pulverization method in which resins, pigments, etc., are mechanically mixed and kneaded, and then pulverized is generally used. However, one of the problems with the pulverization method is that the smaller the particle size of a toner, the more complicated the facilities and processes become for obtaining a desired toner; this has made the production costs high. Another problem is that in terms of the pulverization characteristics, the fluidity is poor.

In contrast, the emulsion dispersing method has been disclosed as a process for the preparation of toners having a small particle size in Japanese Laid-Open Patent Applications No. Hei 3-15078, Hei 4-78863, Hei4-178654, etc. In this method, a polymer solution made by dissolving a polymer in a water-insoluble solvent is emulsified and dispersed in an aqueous dispersion solution so that an O/W type emulsion is formed, and the O/W emulsion was heated while being stirred so as to evaporate the organic solvent, thereby allowing polymer particles to precipitate.

In the emulsion dispersing method, processes are simplified and polymer fine particles are obtained through comparatively simple operations. As compared with the pulverization method, a wide range of resins can be used, and the application of the resulting polymers is widened. At present, in the case when polymer fine particles are obtained by the emulsion dispersing method, an emulsifying machine of a high-speed shearing system, such as T.K. AUTO HOMO MIXER (made by Tokushu Kika K.K.), is utilized in which stirring and mixing are carried out by shearing induced by high-speed revolutions of blades, etc.

However, emulsifying machines of this type are basically operated on a batch basis, resulting in a problem of production efficiency. Moreover, another problem arises due to their inherent mechanical construction wherein layers tend to be separated into two types—a layer subjected to shearing and a layer in convection, it is difficult to obtain a sharp particle size distribution.

SUMMARY OF THE INVENTION

The present invention is to provide a process for efficiently producing a toner for electrophotography having a sharp particle size distribution.

The present invention relates to a process for preparing a toner for electrophotography, which comprises at least the steps of: providing a toner composition solution by mixing a binder resin, a colorant, a charge-control agent and an organic solvent; mixing the resulting toner composition solution with a dispersion solution containing a dispersing agent by utilizing a collision shearing force of beads or using a colloid mill method, thereby obtaining an O/W type emulsion; heating the resulting emulsion so as to eliminate said organic solvent; and obtaining a toner by washing and drying precipitated particles, wherein a viscosity $\eta_A$ of the toner composition solution and a viscosity $\eta_B$ of the dispersion solution satisfies a specified the relationship between $\eta_A$ and 72 $_B$.

DETAILED DESCRIPTION OF THE INVENTION

Figure 1:
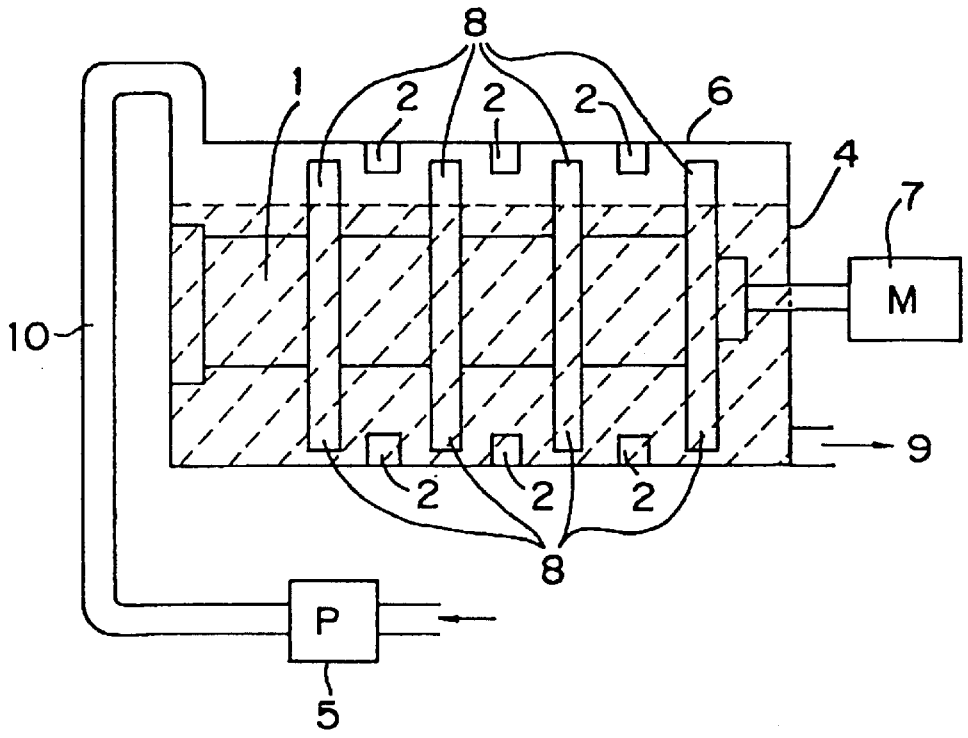
FIG. 1 is a schematic cross-sectional view that shows an example of an emulsifying machine utilizing a collision shearing force of beads, which is used in an emulsifying step in the process of the present invention.

The first aspect of the present invention (referred to "first invention" hereinafter) relates to a process for preparing a toner, comprising the steps of:

providing a toner composition solution by mixing a binder resin, a colorant, a charge-control agent and an organic solvent;

mixing the resulting toner composition solution with a dispersion solution containing a dispersing agent under a collision shearing force caused by beads to give an O/W type emulsion;

heating the resulting emulsion so as to eliminate said organic solvent; and obtaining a toner by washing and drying resulting particles, the relationship between a viscosity $\eta_A$ of the toner composition solution and a viscosity $\eta_B$ of the dispersion solution satisfying the following inequality: $0.5 \leqq \eta_A/\eta_B \leqq 2$.

The second aspect of the present invention (referred to "second invention" hereinafter) relates to a process for preparing a toner, comprising the steps of:

providing a toner composition solution by mixing a binder resin, a colorant, a charge-control agent and an organic solvent;

mixing the resulting toner composition solution with a dispersion solution containing a dispersing agent by using a colloid mill to give an OW type emulsion;

heating the resulting emulsion so as to eliminate said organic solvent; and obtaining a toner by washing and drying resulting particles, the relationship between a viscosity $\eta_A$ of the toner composition solution and a viscosity $\eta_B$ of the dispersion solution satisfying the following inequality: $0.8 \leqq \eta_A/\eta_B \leqq 1.6$.

The first invention is characterized in that when preparing toner particles by using the so-called emulsion dispersing method, the emulsion is carried out by utilizing the collision shearing force of beads; this makes it possible to efficiently prepare a toner for electrophotography having a sharp particle size distribution.

In the first invention, a toner composition solution is prepared by dissolving and/or dispersing at least a binder resin, a colorant and a charge-control agent in an organic solvent. In this case, the viscosity $\eta_A$ of the toner composition solution is set in relation with the viscosity $\eta_B$ of the dispersion solution, which will be described later, so as to have a relationship indicated by $0.5 \leqq \eta_A/\eta_B \leqq 2$. If $\eta_A/\eta_B$ is less than 0.5 or exceeds 2, the emulsion and dispersion can not be carried out efficiently, resulting in failing to obtain toner particles having a sharp particle size distribution. The viscosity $\eta_A$ of the toner composition solution is preferably set in the range of 5 to 50 cP, more preferably in the range of 7 to 40 cP. If $\eta_A$ is less than 5 cP, the particle size becomes too small, making it difficult to obtain toner particles having a desired particle size. If $\eta_A$ exceeds 50 cP, it is difficult to obtain toner particles having a sharp particle size distribution.

The second invention is characterized in that when preparing toner particles by using the so-called emulsion dispersing method, the emulsion is carried out by adopting a colloid mill method; thus, it is possible to efficiently prepare a toner for electrophotography having a sharp particle size distribution. In the present description, "the colloid mill method" refers to a method in which the toner composition solution is emulsified in the dispersion solution by utilizing forces, such as an impact force, a shearing force, a compressing force and a frictional force, that are exerted when the mixture system containing the toner composition solution and the dispersion solution is allowed to pass through the clearance between a rotor and a stator that make high-speed revolutions and a cavitation function due to the high-speed revolutions.

In the second invention, a toner composition solution is prepared by dissolving and/or dispersing at least a binder resin, a colorant and a charge-control agent in an organic solvent. In this case, the viscosity $\eta_A$ of the toner composition solution is set with respect to the viscosity $\eta_B$ of the dispersion solution, which will be described later, so as to have a relationship indicated by $0.8 \leqq \eta_A/\eta_B \leqq 1.6$. If $\eta_A/\eta_B$ is less than 0.8 or exceeds 1.6, the emulsion and dispersion can not be carried out efficiently, resulting in failing to obtain toner particles having a sharp particle size distribution. The viscosity $\eta_A$ of the toner composition solution is preferably set in the range of 5 to 50 cP, more preferably in the range of 7 to 40 cP. If $\eta_A$ is less than 5 cP, the particle size becomes too small (not more than 3 $\mu$m in the average particle size). If $\eta_A$ exceeds 50 cP, it is difficult to obtain toner particles having a sharp particle size distribution.

The binder resin used in the process of the present invention is not particularly limited as long as it is soluble in an organic solvent as will be described later, and is insoluble or hardly soluble in water, and any binder resin used in conventional toners can be used. For example, the following resins can be used alone or in combination: Styrene resins, (metha) acrylic resins, styrene- (metha) acrylic copolymer resin, olefin resins, polyester resins, polyamide resins, polycarbonate resins, polyether resins, polyvinylacetate resins, polysulfone resins, epoxy resins, polyurethane resins, and urea resins.

It is desirabler that the binder resins have a glass transition point (Tg) ranging from 50 to 70° C., , a number average molecular weight (Mn) ranging from 1,000 to 50,000, and more preferably from 3,000 to 20,000 and a molecular weight distribution (Mw/Mn) represented by a ratio between Mn and the weight-average molecular weight (Mw) of 2to 60, more preferably, 2 to 5 with respect to the molecular weight. If Tg is less than 50° C., the resulting toner is inferior in its heat resistance. If it exceeds 70° C., the resulting toner is inferior in its fixing properties. Mn less than 1000 tends to cause high-temperature offset to the resulting toner. Mn exceeding 50,000 tends to cause low-temperature offset.

With respect to the colorants used in the present invention, various organic or inorganic pigments having various colors are listed as described below.

As for black pigments, for example, carbon black, copper oxide, manganese dioxide, aniline black, active carbon, non-magnetic ferrite, magnetic ferrite, magnetite, etc. are listed.

As for yellow pigments, for example, chrome yellow, zinc yellow, cadmium yellow, yellow iron oxide, mineral fast yellow, nickel titanium yellow, navel yellow, naphtol yellow s, Hansa Yellow G, Hansa Yellow 10G, benzidine yellow G, benzidine yellow GR, quinoline yellow lake, permanent yellow NCG, Tartrazine lake, etc. are listed.

As for orange pigments, for example, red chrome yellow, molybdenum orange, permanent orange GTR, pyrazolone orange, vulcan orange, Indanthrene Brilliant Orange RK, benzidine orange G, Indanthrene Brilliant Orange GK, etc. are listed.

As for red pigments, for example, iron oxide red, cadmium red, minium, mercury sulfide, cadmium, permanent red 4R, lithol red, pyrazolone red, watching red, calcium salt, Lake Red C, Lake Red D, Brilliant Carmine 6B, Eosin Lake, Rhodamine Lake B, alizarine lake, Brilliant Carmine 3B, etc. are listed.

As for blue pigments, for example, Prussian blue, cobalt blue, alkali blue lake, Victorian Blue Lake, phthalocyanine blue, non-metal phthalocyanine blue, phthalocyanine blue, partial chloride, Fast Sky Blue, Indanthrene Blue BC, etc. are listed.

As for extender pigments, for example, barytes powder, barium carbonate, clay, silica, white carbon, talc, alumina white, etc. are listed.

It is preferable to use 1 to 20 parts by weight, and more preferably, 2 to 15 parts by weight, of these colorants, with respect to 100 parts by weight of the above-mentioned binder resin. The amount of colorants exceeding 20 parts by weight causes degradation in the fixing properties of the toner. The amount of them less than 1 part by weight makes it difficult to obtain a desired image density. In the case when a plurality of colorants are used, they are added so that the total amount thereof is set within the above-mentioned range.

With respect to the charge-control agent (CCA) used in the present invention, various substances which can impart a positive or negative charge through frictional charging are listed. For example, the following substances are listed: As for positive charge-control agent, nigrosine dyes such as Nigrosine Base EX (made by Orient Kagaku kogyo K.K.), quaternary ammonium salts, such as quaternary ammonium salt P-51 (made by Orient Kagaku kogyo K.K.) and Copy Charge PX VP435 (made by Hoechst K. K.), alkoxylated amine, alkyl amide, molybdenum acid chelate pigments, and imidazole compounds such as PLZ1001 (made by Shikoku Kasei Kogyo K. K.). As for negative charge-control agent, metallic complexes such as Bontrons S-22, S-34, E-81, E-84 (made by Orient Kagaku kogyo K.K.) and Spilon Black TRH (made by Hodogaya Kagaku kogyo K.K.), compounds containing fluorine, such as thioindigo pigments, Copy Charge NX VP434 (made by Hoechst K. K.) and FT-300, 310 (made by Neosu K.K.), and calix arene compounds such as Bontron E-89 (made by Orient Kagaku kogyo K.K.).

With respect to these CCAs, one of them or a plurality of them can be used. However, regardless of a sole application or plural applications, the total amount of use of CCA (total amount of load) is preferably set in a range of 0.1 to 5 parts by weight with respect to 100 parts by weight of the binder resin contained in the toner. If the content of CCA is less than 0.1 part by weight, there is a fear that a sufficient charging performance can not be obtained. If the content of any one of them exceeds 5 parts by weight, there is a fear that spent phenomenon might appear with respect to a charge-giving member when repeatedly copied, thereby causing a reduction in the charging amount.

In addition to the above-mentioned toner components, desired additive agents, such as an anti-offset agent and a magnetic particle, may be dissolved or dispersed in the toner composition solution. With respect to the anti-offset agent, not being specifically limited. However, for example, the following materials may be used: polyethylene wax, oxidized-type polyethylene wax, polypropylene wax, oxidized-type polypropylene wax, carnauba wax, sazole wax, rice wax, candelilla wax, jojoba oil wax, bees wax, etc. An amount of addition of such waxes is preferably set in the range of 0.5 to 20 parts by weight, and more preferably to 10 parts by weight, with respect to 100 parts by weight of the binder resin. If the amount of addition is less than 0.5 part by weight, the effects of the addition are insufficient. If it exceeds 20 parts by weight, the resulting toner has degradation in the light-transmitting properties and color reproducibility. With respect to magnetic particles, magnetite, γ-hematite, various ferrites, etc. are listed, and its amount of application is preferably set in the range of 1 to 20 parts by weight with respect to 100 parts by weight of the binder resin.

With respect to the organic solvent, those of water-insoluble solvents which can dissolve the above-mentioned binder resins can be used: For example, toluene, xylene, benzene, tetrachlorocarbide, methylene chloride, 1,2-dichloroethane, 1,1,2-trichloroethane, trichloroethylene, chloroform, monochlorobenzene, dichloroethylidene, methylacetate, ethylacetate, methylethylketone, methylisobutylketone, a mixture thereof etc. are used alone or in combination. Among them, aromatic compounds such as toluene and xylene are preferably used.

When dissolving and/or dispersing the above-mentioned toner materials in an organic solvent, a commonly-used device, such as a ball mill, a sand grinder and an ultrasonic homogenizer, may be adopted.

The concentration of solid components in the toner composition solution (concentration of all solid components including the binder resin, CCA, colorants, etc. in organic solvent) varies mainly based upon the solubility of the binder resin with respect to the organic solvent. Therefore, it is appropriately adjusted so as to satisfy the aforementioned relationship between the viscosity $\eta_A$ of toner composition solution and the viscosity $\eta_B$ of the dispersion solution. In general, however, it is preferably set in a range of 5 to 50% by weight, and more preferably 10 to 40% by weight.

In the process of the present invention, the toner composition solution, thus obtained, is added to a dispersion solution containing a dispersing agent, and is emulsified by using the collision shearing force of beads, or emulsified by using the colloid mill method, so that an O/W type emulsion is obtained.

The dispersion solution to which the toner composition solution is added contains a dispersing agent and other desired additive agents, such as a dispersion-aiding agent, that are added to water. With respect to the dispersing agent, those substances that form a hydrophilic colloid in the aqueous dispersion solution are preferably used. In particular, the following substances are listed: gelatin, Arabic rubber, agar, cellulose derivatives (such as hydroxymethylcellulose and hydroxyethylcellulose), synthetic polymers (such as polyvinylalcohol, polyvinyl pyrrolidone, salts of polyacrylic acids, and salts of polymethacrylic acids), inorganic salts that are almost insoluble (such as calcium phosphate, etc.), hydrophilic silica, etc.

With respect to the dispersion-aiding agent, a surface active agent is normally used, and examples thereof include: natural surface active agents such as saponine, nonionic surface active agents, such as alkylene oxides, glycerins or glycidoles, and anion surface active agents containing an acid group such as a carbonic acid, a sulfonic acid, a phosphoric acid, a sulfate ester group and a phosphate ester group.

It is necessary for the viscosity $\eta_B$ of the dispersion solution to satisfy the above-mentioned relationship together with the viscosity $\eta_A$. Here, $\eta_B$ is preferably set in the range of 1.5 to 50 cP, and more preferably 3 to 40 cP. If $\eta_B$ is less than 1.5 cP, it becomes impossible to obtain toner particles having a sharp particle-size distribution. If it exceeds 50 cP, the viscosity becomes too high, thereby failing to provide a uniform emulsion and causing a discharging problem of the emulsified solution.

In the first invention, when emulsifying the toner composition solution in the dispersion solution, the collision shearing force of beads is utilized. Any bead mill may be used being not specifically limited, as long as it can uniformly mix and stir the mixture system of the toner composition solution and the aqueous dispersion solution by utilizing the collision shearing force of beads. For example, Eiger Motor Mill (made by Eiger Torrance LTD), Dyno Mill (made by WAB K. K. (Willy A. Bachofen AG Maschinenfabrik)), etc. can be used.

More specifically, referring to the schematic cross-sectional view of the Aigar Motor Mill shown in FIG. 1, an explanation will be given. In this machine, a cylinder-shaped casing 6 is provided horizontally. An agitator 1 is axially supported therein so as to be rotated and driven by a motor 7. One end of a pipe 10 used for injecting materials is connected to the side face of the casing. The materials are injected into the casing by driving a pump 5 that is connected to the other end of the pipe. The agitator 1 has a plurality of disc-shaped convexes 8. Protruding baffles 2 are formed on the inner wall of the casing so as to be located between the convexes. Numerous beads are housed in the gap between the agitator 1 and the inner wall of the casing. The beads are stirred forcefully, following the rotation of the agitator 1, and allowed to collide with one another (in FIG. 1, the area filled with beads is indicated by slanting dotted lines). The casing 6 is tightly closed by bolting a lid through a screen 4, and a discharging pipe 9 is connected to the lid.

In the machine having the above-mentioned construction, when the pump 5 is operated while rotating the agitator 1, the mixture system (the mixture containing the toner composition solution and the dispersion solution) is injected to one end inside the casing through the pipe 10. The mixture system, thus injected, is allowed to flow toward the other end of the casing through the gap between the inner wall of the casing and the agitator 1 by the pressurizing force of the pump 5 and the propelling force of the agitator 1, while being subjected to the shearing force of beads that collide with one another forcefully by the rotation of the agitator 1. Thus, it is sufficiently stirred, and discharged outside as an emulsion through the discharging pipe 9.

The particle size of each droplet of the toner composition solution in the emulsion is directly related to the size of toner particles that will be finally obtained. Therefore, it is necessary to form the droplet that corresponds to the size of the toner particles to be obtained, and also to control the particle-size distribution thereof sufficiently. In this respect, in the present invention, since the emulsion is carried out by using the bead mill having the above-mentioned construction, it becomes possible to emulsify the toner composition solution so as to have fine particle sizes uniformly in the dispersion solution, and consequently to prepare an emulsion having a sharp droplet particle-size distribution. Moreover, the bead mill having the above-mentioned construction, used in the present invention, is capable of being continuously driven. In other words, being different from the batch system, it is possible to continuously obtain the emulsified matter by successively supplying the materials. Therefore, the throughput is remarkably enhanced. The toner can be prepared effectively. In this manner, the present invention makes it possible to efficiently prepare the emulsion containing fine particle-size droplets having a sharp droplet particle-size distribution. Therefore, it becomes possible to efficiently prepare a toner for electrophotography having a sharp particle-size distribution.

In the emulsifying step of the process of the first invention, by properly selecting the time during which the collision shearing force is applied by the bead mill, that is, the time during which the mixture system of the toner composition solution and the dispersion solution is allowed to pass the casing, it becomes possible to obtain an emulsion in which droplets having a desired particle size are dispersed. If the time is too short, the emulsion in which droplets have achieved a desired particle size can not be obtained. If it is too long, the particle size of the droplets in the emulsion becomes too small.

The time required for emulsification of the above-mentioned mixture system and required for preparing the emulsion in which droplets having a specific particle size are dispersed, depends on bead mill characteristics, such as bead diameter, specific gravity of the bead, agitator rotational speed, bead filling rate in the casing, the length of the casing in the axial direction and pump pressure, as well as the aforementioned $\eta_A$ and $\eta_B$; therefore, it is appropriately determined taking these factors into consideration. For example, in the case when an emulsion whose droplets have a volume average particle size of approximately 6 $\mu$m is desired, the time required for emulsification generally has to be set in approximately one minute under the conditions that a bead diameter of 1 mm, a specific gravity of the bead of 3.8, an agitator rotational speed of 3,000 rpm (50 Hz in frequency), a bead filling rate in the casing of 80% by volume, a length of the casing in the axial direction of 15 cm, $\eta_A$ of 9.6 cP and $\eta_B$ of 8.8 cP. When $\eta_A$ of 32.0 cP and $\eta_B$ of 28.0 cP are applied by using the bead mill having the above-mentioned bead mill characteristics, it is necessary that the time required for emulsification also is set to approximately one minute.

Since the bead mill having the above-mentioned construction has an extremely high processing speed, the throughput in the process of the present invention is extremely enhanced as compared with conventional processes. More specifically, the processing speed of the emulsifying step of the process of the present invention ensures at least approximately 50 liters/hour. Therefore, in terms of the processing time, the same kind and the same amount of emulsion can be prepared in the time approximately 1/10 of that of a conventional emulsifying process.

Figure 2:
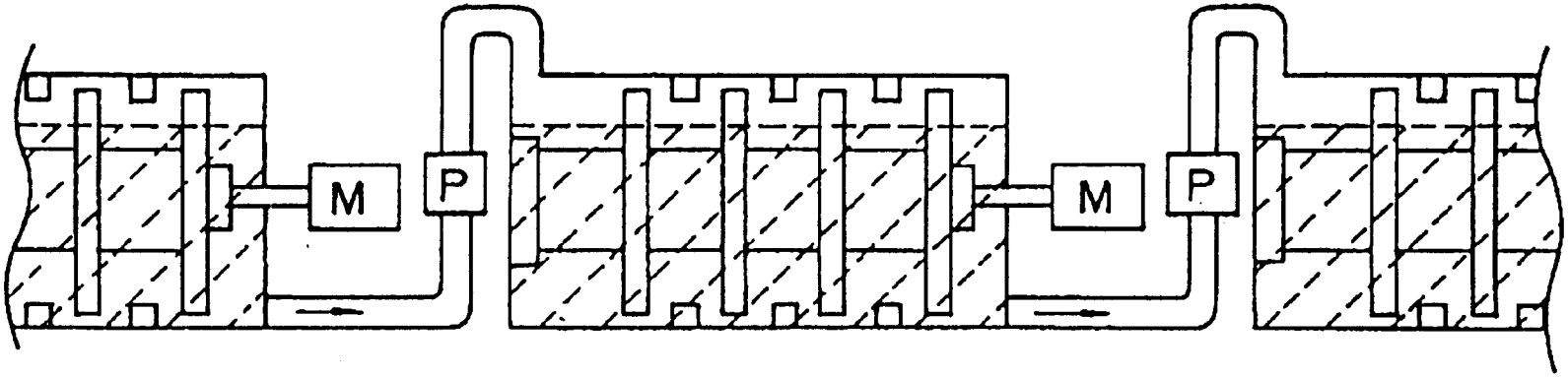
FIG. 2 is a conceptual drawing showing a case in which the emulsifying machines of FIG. 1 are connected in series with each other.
Figure 3:
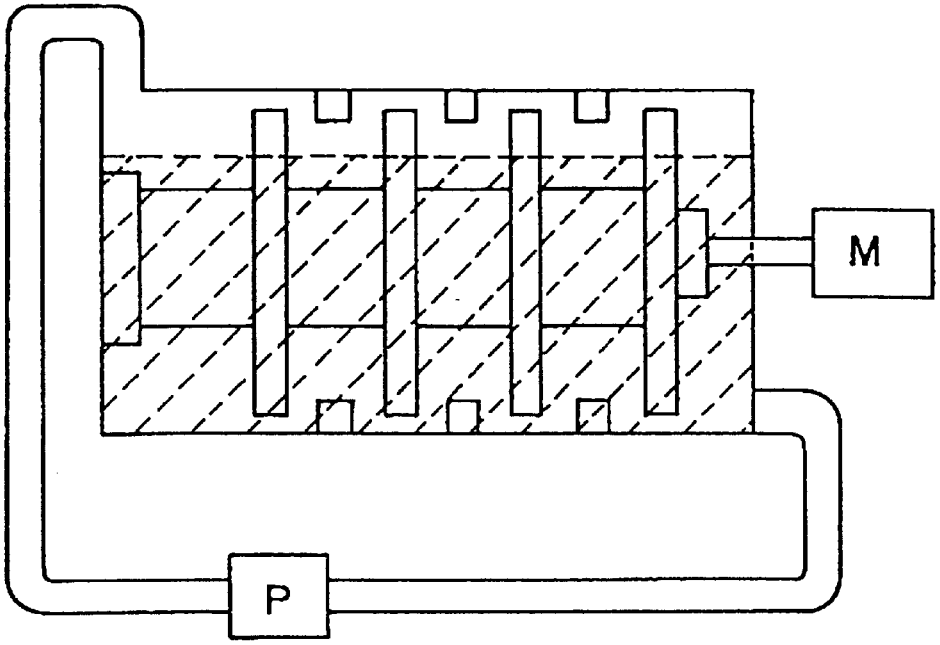
FIG. 3 is a conceptual drawing showing a case in which a mixture system is circulated in the emulsifying machine of FIG. 1.

Since the processing speed is too fast, it might be considered that ensuring the above-mentioned time required for emulsification is hard. However, in the first invention, it is possible to ensure an appropriate time required for emulsification by adopting the following arrangements: a plurality of bead mills having the above-mentioned construction are connected as illustrated in FIG. 2; the emulsified matter discharged from the discharging pipe 9 is further supplied into the casing through the pump 5 so as to be circulated in a plurality of times as shown in FIG. 3; or the length of the casing and the length of the agitator may be extended.

With respect to beads used in the bead mill in the process of the first invention, beads, such as glass beads, zirconia beads, ferrite beads and ferrite beads with resin coating, which have a bulk specific gravity in the range of not less than 1.5 to not more than 10.0, maybe used. If the diameter of the beads is too small, it may be hard to carry out a smooth rotation driving of the agitator. If it is too large, it may not be possible to effectively obtain an emulsion in which droplets having a desired particle size are dispersed. Therefore, in general, the diameter is preferably set in the range of 0.05 to 10 mm, and more preferably 0.5 to 2 mm. The casing is filled with the above-mentioned beads preferably in the range of 50 to 90% by volume, and more preferably 60 to 85% by volume with respect to the volume of the casing. If the filling rate is too small, the emulsification may become insufficient. If it is too high, the emulsified liquid might not be discharged. The casing volume is defined as a value obtained by subtracting a volume occupied by the agitator, the convexes and baffles inside the casing from the total inner volume of the cylinder-shaped casing. The agitator rotational speed is not particularly limited, as long as it allows the injected mixture system to flow toward the other end of the casing through the gap between the inner wall of the casing and the agitator while being subjected to the shearing force of beads that forcefully collide with one another by the rotation of the agitator. However, it is preferable to set it to at least 2,000 rpm, and more preferably in the range of 2,400 to 5,000 rpm. The length of the casing in the axial direction and the inner diameter of the casing are dependent on the performance of a motor, and are not particularly limited. However, if the length of the casing is too long, it is expected that there is a difficulty in discharging. If it is too short, it becomes hard to ensure an appropriate time required for emulsification. With respect to the pump pressure, it is adjusted to provide a speed identical to the processing speed.

With respect to the mixture system that is subjected to the collision shearing force by the bead mill, a weight ratio of mixture (weight of the toner composition solution/weight of the dispersion solution) of the toner composition solution and the dispersion solution is preferably set in a range of not less than 0.3 to not more than 1. If the weight ratio exceeds 1, the emulsification becomes insufficient, resulting in failure to obtain droplets having a desired particle size. In the case of less than 0.3, the productivity decreases, and the particle size becomes too small, although emulsification is available.

In the second invention, when emulsifying the toner composition solution in the dispersion solution, a colloid mill method is adopted. Specifically, a colloid mill is adopted in which forces, such as an impact force, a shearing force, a compressing force and a frictional force, that are exerted when the materials to be processed is allowed to pass through the clearance between a rotor that rotates at a high speed and a stator, and a cavitation function due to the high-speed revolutions, are utilized. For example, Mini Colloider (MC-1; made by SMT K.K.), T.K. My Colloider (made by Tokushukika K.K.), etc. are used.

More specifically, for example, referring to a schematic cross-sectional view of the Mini Colloider in FIG. 4, an explanation will be given. The present machine is constituted by a rotor 1 that makes high-speed revolutions and a stator 2 that is fixed. The rotor 1 is connected to a motor 6 by a motor shaft 4 so as to be rotated by driving force of the motor 6. The clearance between the rotor 1 and the stator 2 can be freely adjusted, and the rotational speed of the rotor can also be adjusted. The adjustment of the clearance is carried out by a known method (not shown), in which, for example, the rotor or the stator is raised or lowered in up and down directions.

In the machine having the above-mentioned construction, when the mixture system is supplied through a hopper 3 provided at an upper portion thereof while the rotor 1 is being rotated, upon passing through the clearance between the rotor 1 and the stator 2, the mixture system receives strong forces, such as an impact force, a shearing force, a compressing force and a frictional force, and the cavitation function due to the high-speed revolutions, from a rotor clearance face 11 and/or a stator clearance face 2' that is placed opposing thereto so as to form the clearance. Thus, it may be possible to obtain an emulsion in which the toner composition solution has been emulsified with fine particle sizes in the dispersion solution. The emulsion thus obtained is discharged through an outlet 5.

Figure 4:
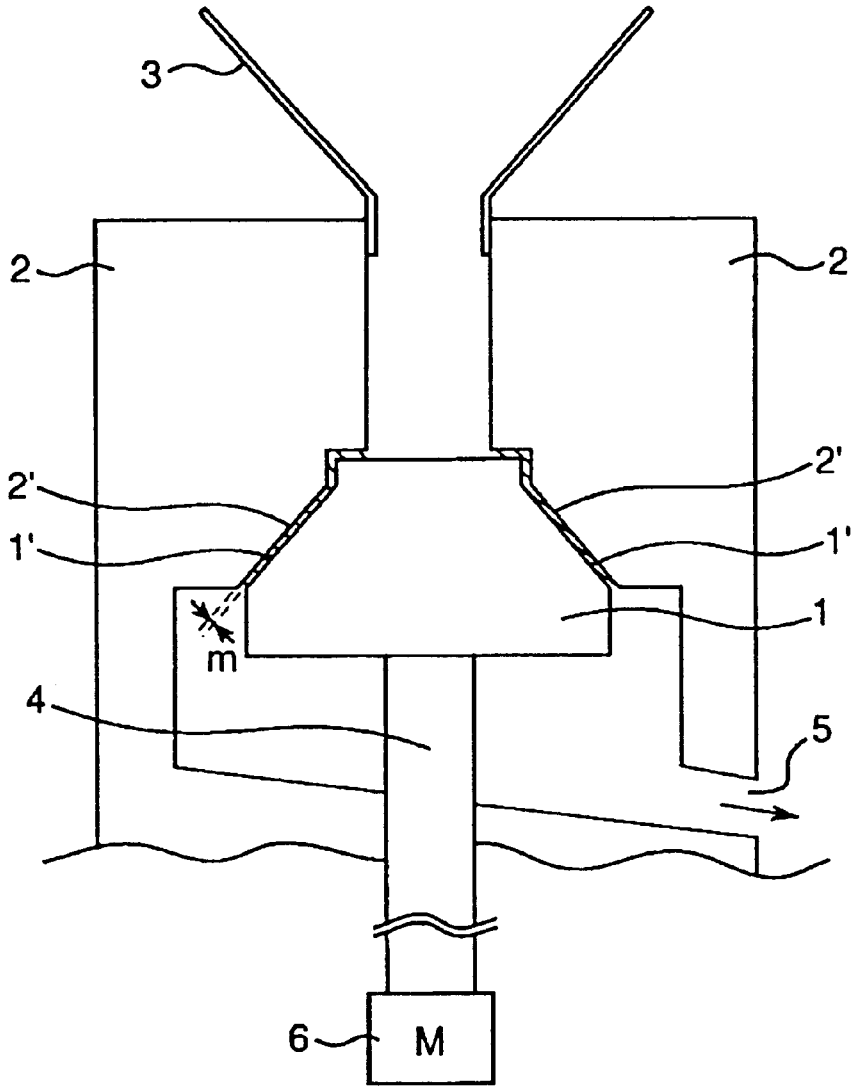
FIG. 4 is a schematic cross-sectional view that shows an example of an emulsifying machine using the colloid mill method, which is used in an emulsifying step in the process of the present invention.
Figure 7:
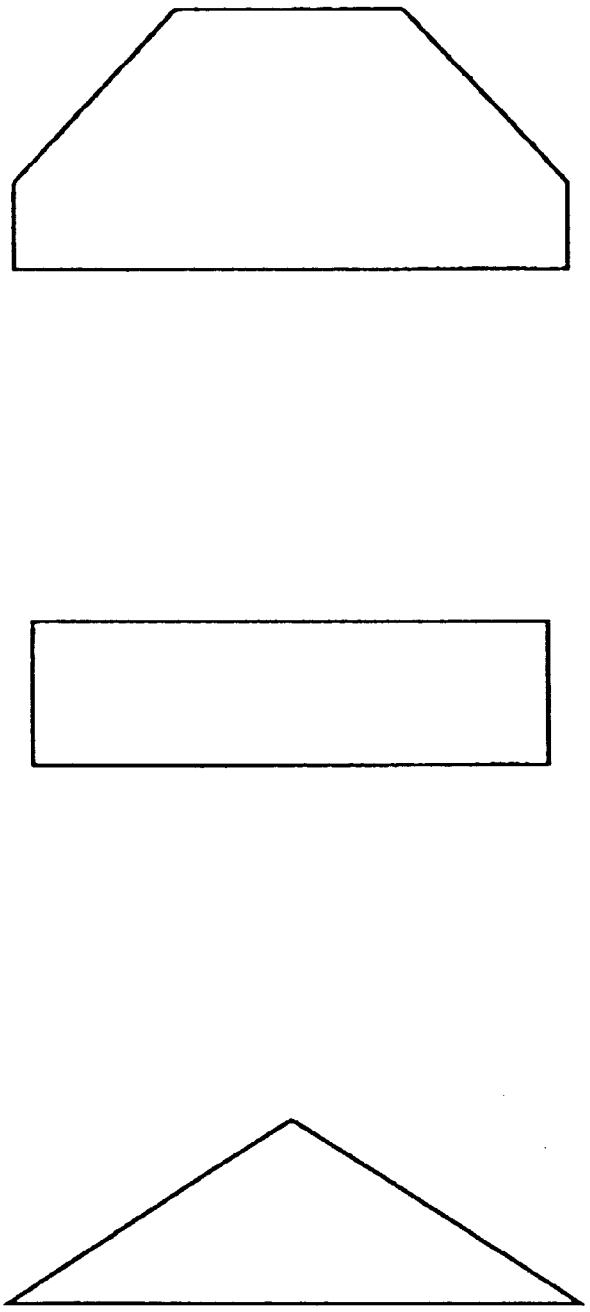
FIG. 7 shows a schematic cross-sectional view of an example of a rotor.

FIG. 4 shows the schematic cross-sectional view of the Mini Colloider as one example of a colloid mill used in the process of the present invention. However, the present invention is not intended to be limited thereto. Any colloid mill may be adopted as long as it applies to the mixture system forces such as an impact force, a shearing force, a compressing force and a frictional force (hereinafter, referred to simply as an impact force, etc.), and the cavitation function, from the rotor clearance face 1' and/or the stator clearance face 2' that is placed opposing thereto so as to form the clearance, when the mixture system is allowed to pass through the clearance between the rotor and the stator. Therefore, the cross-sectional shape of the rotor is not also limited to the shape shown in FIG. 4. Various shapes, such as a trapezoid, a square and a triangle, as shown in FIG. 7, may be adopted, as long as it is set within the range that allows the rotor clearance face and/or the stator clearance face to apply an impact force, etc. and the cavitation function to the mixture system. In this case, it is preferable to change the shape of the stator clearance face in accordance with the shape of the rotor clearance face.

The particle size of each droplet of the toner composition solution in the emulsion is directly related to the size of toner particles that will be finally obtained. Therefore, it is necessary to form the droplet that corresponds to the size of the toner particles to be obtained, and also to control the particle-size distribution thereof sufficiently. In this respect, in the second invention, since the emulsion is carried out by using the colloid mill method, it becomes possible to emulsify the toner composition solution so as to have fine particle sizes uniformly in the dispersion solution, and consequently to prepare an emulsion having a sharp droplet particle-size distribution. Moreover, the colloid mill having the above-mentioned construction, used in the second invention, is capable of being continuously driven. Being different from the batch system, it is possible to continuously obtain the emulsified matter by successively supplying the materials. Therefore, the throughput is remarkably enhanced, and the toner can be prepared effectively. In this manner, the present invention makes it possible to efficiently prepare the emulsion containing fine particle-size droplets having a sharp droplet particle-size distribution. It becomes possible to efficiently prepare a toner for electrophotography having a sharp particle-size distribution.

For example, when the Mini Colloider as shown in FIG. 4 is used, the particle size of emulsion droplets to be obtained is dependent upon the rotor rotational speed and clearance conditions in addition to the viscosity of the toner composition solution $\eta_A$ and the viscosity of the dispersion solution $\eta_B$. Therefore, if the rotor rotational speed is too slow or if the thickness (m), indicated by slanting lines in FIG. 4, is too large, it becomes not possible to obtain an emulsion having droplets which have attained a desired particle size. If the rotor rotational speed is too fast, or if the value m is too small, the particle size of the droplets in the emulsion becomes too small. In general, the rotor rotational speed is preferably set in the range of 3,000 to 8,000 rpm (50.5 to 134 Hz), and more preferably 5,000 to 7,000 rpm (84 to 117 Hz), and the value m is preferably set in the range of 0.3 to 3.0 mm, and more preferably 0.1 to 2.5 mm. In addition, a too narrow thickness (m) of the clearance might cause a difficulty in discharging the emulsified emulsion.

Since the colloid mill having the above-mentioned construction has an extremely high processing speed, the throughput in the process of the second invention is extremely enhanced as compared with conventional processes. More specifically, the processing speed of the emulsifying step of the process of the second invention ensures at least approximately 50 liters/hour. Therefore, in terms of the processing time, the same kind and the same amount of emulsion can be prepared in the time approximately 1/10 of that of a conventional emulsifying process.

Figure 5:
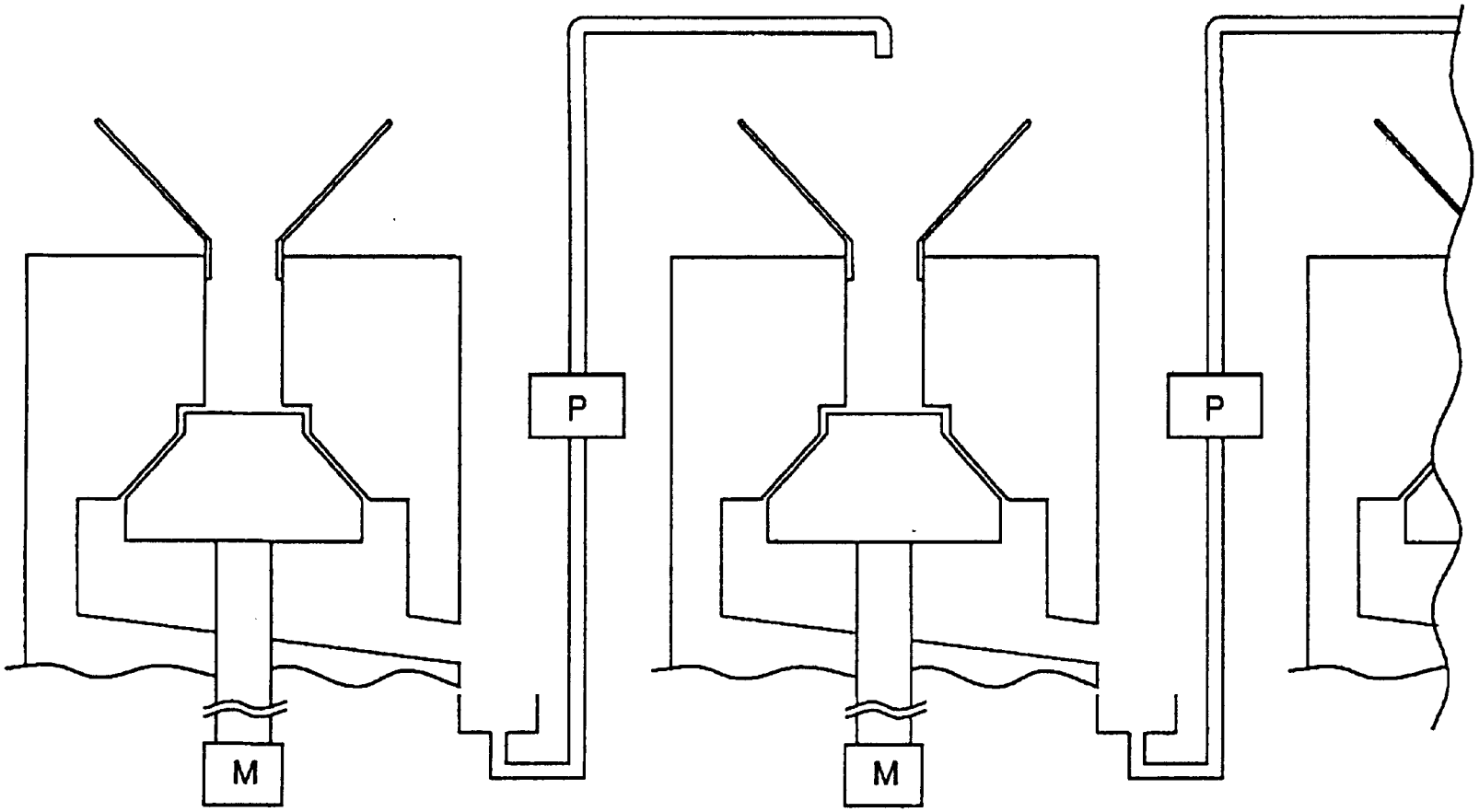
FIG. 5 is a conceptual drawing showing a case in which the emulsifying machines of FIG. 4 are connected in series with each other.
Figure 6:
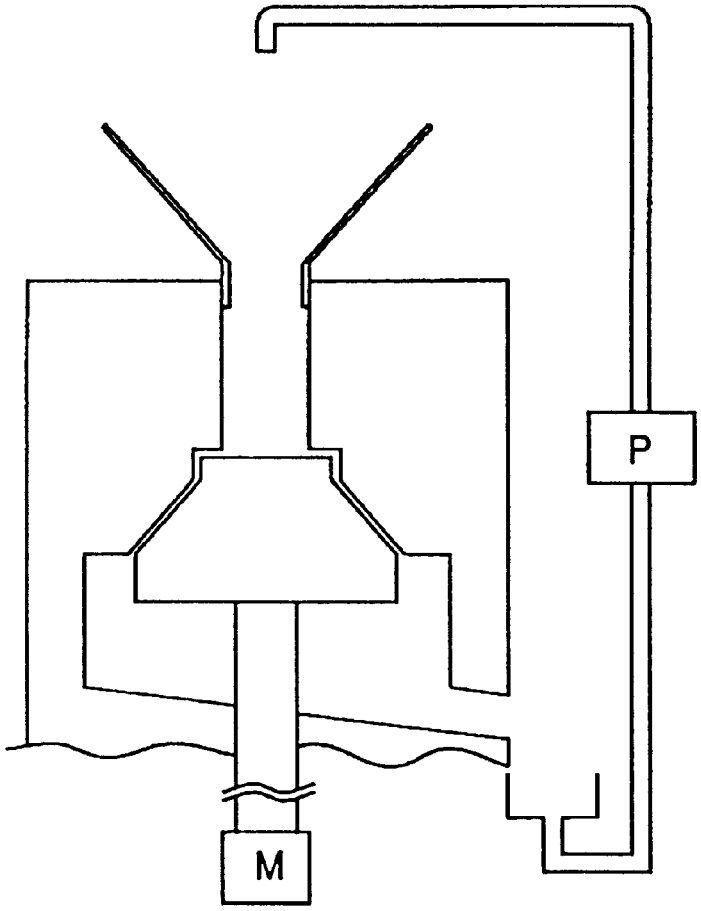
FIG. 6 is a conceptual drawing showing a case in which a mixture system is circulated in the emulsifying machine of FIG. 4.

In the second invention, if a desired emulsion is not obtained by an emulsifying step carried out only once, it is possible to appropriately adjust the particle size of the droplets in the emulsion by adopting the following arrangements: a plurality of colloid mills having the above-mentioned construction are connected as illustrated in FIG. 5; and the emulsified matter discharged from the discharging pipe is further supplied into the hopper through the pump so as to be circulated in a plurality of times as shown in FIG. 6.

With respect to the mixture system that is subjected to the colloid mill method, a weight ratio of mixture (weight of the toner composition solution/weight of the dispersion solution) of the toner composition solution and the dispersion solution is preferably set in a range of not less than 0.3 to not more than 1. If the weight ratio exceeds 1, a W/O emulsion is easily obtained, failing to precipitate toner particles. In the case of less than 0.3, the emulsion becomes insufficient, thereby causing a possibility that droplets having a desired particle size are not obtained.

In the present description, an explanation has been given of a case in which a toner composition solution is added to a dispersion solution containing a dispersing agent so that the obtained mixture system is subjected to an emulsifying step. However, the present invention is not intended to be limited thereto. As long as the volume ratio of mixture is in the above-mentioned range, a dispersion solution containing a dispersing agent may be added to a toner composition solution so as to obtain a mixture system that is subjected to the emulsifying step.

The emulsion that has been prepared as described above is heated. After the organic solvent has been eliminated, the resulting precipitated particles are washed and dried so that toner particles having a volume average particle size approximately in the range of 1 to 10 $\mu$m, and more preferably 3 to 7 $\mu$m, are obtained. The particle-size distribution of the toner particles thus obtained is sharper than the particle-size distribution of particles obtained by a conventional emulsification dispersion method; that is, a ratio (Dv/Dp) of the volume average particle size (Dv) and the number average particle size (Dp) is preferably set at not more than 1.4, and more preferably not more than 1.3.

The heating method of the emulsion and the washing and drying methods of the precipitated particles are not particularly limited. Any of known methods adopted in a conventional process for preparing toners by the emulsification dispersion method may be adopted. More specifically, with respect to the heating method, for example, a method for carrying out a heating step under a reduced pressure so as to lower the boiling point of the organic solvent in relation with the binder resin, etc. are adopted. With respect to the washing method, for example, a method for repeating the filtration and washing of the precipitated particles with water, a centrifugal separation method, an ultrasonic washing method, etc. may be adopted. With respect to the drying method, a method in which a drying step is carried out for 36 to 60 hours at a temperature ranging 30 to 40° C. and then a pulverizing step is applied by a mixing device such as a ball mill since the particles tend to adhere to and solidify with each other, a spray drying method, a freeze dry method, etc. are adopted.

The toner obtained by the process of the present invention may be improved with respect to its fluidity by externally adding a fluidity-enhancing agent, etc. thereto. The toner can be used in both developer systems, that is, a monocomponent developer without a carrier and a two-component developer with a carrier. As clearly understood, the process of the present invention is not intended to be limited to a process for preparing a toner for electrophotography, and it is clear that the present invention is useful in any field wherein polymer particles of a fine particle size having a sharp particle size distribution are desired.

The process of the present invention will be described in more detail by means of the following examples.

EXAMPLE I-1

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K. K.) serving as a charge-control agent and 2 g of E-84 (made by Orient K.K.). The resultant mixture was put into a 2 liter polyethylene bin, mixed and dispersed by ultra Turrax (made by IKA K.K.) for 30 minutes. Thus, a uniform toner composition solution ($\eta_A$=9. 6) was prepared. The toner composition solution thus obtained was mixed into a dispersion solution ($\eta_B$=8.8) prepared by dissolving 0.01 g of alkyldiphenyl ether sodium disulfonate in 1,000 g of a 3.0 wt % aqueous solution of PVA PA-18 (made by Shinetsu Kagaku K.K.). The obtained solution was subjected to repeated emulsifying steps five times by Eiger Motor Mill (made by Aiga Japan K.K.) at a frequency of 50 Hz. More specifically, as shown in FIG. 3, emulsion discharged from the discharging pipe 9 was further re-supplied into the casing through the pump 5, and circulated five times. The total time required for emulsification was approximately 1 minute. The Eiger Motor Mill used had a volume of 300 cc, beads were zirconia (zirconium oxide) beads, and the bead filling rate was 80%.

Then, toluene was removed under conditions of 60° C. to 65° C. and 140 mmHg to 70 mmHg. The resultant mixture was cooled and subjected to filtration/washing with water several times. After washing, the resulting toner cake was transferred to a stainless vat, dried in a constant temperature drier at 35° C. for 48 hours, pulverized by a ball mill and filtered with a 90 $\mu$m-mesh filter to give toner particles.

EXAMPLE I-2

One hundred (100) grams of low molecular weight polyester (Mw: 13,700,Mn:4,200, Tg: 60° C.) was dissolved in 230 g of toluene, to this were added 6 g of a phthalocyanine pigment, 1 g of VP-434 (made by Hoechst K. K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=32.0) was prepared. The toner composition solution thus obtained was mixed into a dispersion solution ($\eta_B$=28.0) prepared by dissolving 0.007 g of alkyl diphenyl ether sodium disulfonate in 660 g of a 5.0 wt % aqueous solution of PVA PA-18 (made by Shinetsu Kagaku K.K.). The obtained solution was subjected to repeated emulsifying steps five times by Eiger Motor Mill (made by Aiga Japan K.K.) at a frequency of 60 Hz. More specifically, as shown in FIG. 3, emulsion discharged from the discharging pipe 9 was further re-supplied into the casing through the pump 5, and circulated five times. The total time required for emulsification was approximately 1 minute. The same Eiger Motor Mill as used in Example I-1 was used. Thereafter, in the same manner as Example I-1, the solvent was removed, and the resulting product was cooled, subjected to filtration/washing with water several times, and then dried. Thus toner particles were obtained.

EXAMPLE I-3

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K. K.) serving as a charge-control agent and 2 g of E-84 (made by Orient K.K.). The resultant mixture was placed in a 2 liter polyethylene bin, mixed and dispersed by Ultra Turrax (made by IKA K.K.) for 30 minutes. Thus, a uniform toner composition solution ($\eta_A$=9.6) was prepared. The toner composition solution thus obtained was mixed into a dispersion solution ($\eta_B$=18.5) prepared by dissolving 0.01 g of alkyl diphenyl ether sodium disulfonate in 1,000 g of a 4.0 wt % aqueous solution of PVA PA-18 (made by Shinetsu Kagaku K.K.). The obtained solution was subjected to repeated emulsifying steps five times by Eiger Motor Mill (made by Aiga Japan K.K.) at a frequency of 40 Hz. More specifically, as shown in FIG. 3, emulsion discharged from the discharging pipe 9 was further re-supplied into the casing through the pump 5, and circulated five times. The total time required for emulsification was approximately 1 minute. The same Eiger Motor Mill as used in Example I-1 was used. Thereafter, in the same manner as Example I-1, the solvent was removed, and the resulting product was cooled, subjected to filtration/ washing with water several times, and then dried. Thus, toner particles were obtained.

EXAMPLE I-4

One hundred (100) g of low molecular weight polyester (Mw: 13,700, Mn:4,200, Tg: 60° C.) was dissolved in 300 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was placed in a 2 liter polyethylene bin, mixed and dispersed by Ultra Turrax (made by IKA K.K.) for 30minutes. Thus, a uniform toner composition solution ($\eta_A$=17.5) was prepared. The toner composition solution thus obtained was mixed into a dispersion solution ($\eta_B$=8.8) prepared by dissolving 0.008 g of alkyl diphenyl ether sodium disulfonate in 800 g of a 3.0 wt % aqueous solution of PVA PA-18 (made by Shinetsu Kagaku K.K.). The obtained solution was subjected to repeated emulsifying steps five times by Eiger Motor Mill (made by Eiger Japan K.K.) at a frequency of 60 Hz. More specifically, as shown in FIG. 3, emulsion discharged from the discharging pipe 9 was further re-supplied into the casing through the pump 5, and circulated five times. The total time required for emulsification was approximately 1 minute. The same Eiger Motor Mill as used in Example I-1 was used. Thereafter, in the same manner as Example I-1, the solvent was removed, and the resulting product was cooled, subjected to filtration/washing with water several times, and then dried. Thus, toner particles were obtained.

COMPARATIVE EXAMPLE I-1

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=9.6) was prepared. The toner composition solution thus obtained was mixed into a dispersion solution ($\eta_B$=8.8) prepared by dissolving 0.01 g of alkyldiphenylethersodiumdisulfonate in 1000 g of a 3.0 wt % aqueous solution of PVA PA-18 (made by Shinetsu Kagaku K.K.). The obtained mixture was emulsified by T.K Autohomomixer (made by Tokushukika Kogyo K.K.) at the number of revolutions of 4,000 rpm for 10 minutes. Thereafter, in the same manner as Example I-1, the solvent was removed, and the resulting product was cooled, subjected to filtration/washing with water several times, and then dried. Thus, toner particles were obtained.

COMPARATIVE EXAMPLE I-2

One hundred (100) g of low molecular weight polyester (Mw: 13,700, Mn:4,200, Tg: 60° C.) was dissolved in 230 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=32.0) was prepared. The toner composition solution thus obtained was mixed into a dispersion solution ($\eta_B$=28.0) prepared by dissolving 0.007 g of alkyl diphenyl ether sodium disulfonate in 660 g of a 5.0 wt % aqueous solution of PVA PA-18 (made by Shinetsu Kagaku K.K.). The obtained solution was emulsified by T.K Autohomomixer (made by Tokushukika Kogyo K.K.) at the number of revolutions of 5,000 rpm for 10 minutes. Thereafter, in the same manner as Example I-1, the solvent was removed, and the resulting product was cooled, subjected to filtration/washing with water several times, and then dried. Thus, toner particles were obtained.

COMPARATIVE EXAMPLE I-3

One hundred (100) g of low molecular weight polyester (Mw: 13,700, Mn:4,200, Tg: 60° C.) was dissolved in 270 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=20.0) was prepared. The toner composition solution thus obtained was mixed into a dispersion solution ($\eta_B$=8.8) prepared by dissolving 0.007 g of alkyl diphenyl ether sodium disulfonate in 740 g of a 3.0 wt % aqueous solution of PVA PA-18 (made by Shinetsu Kagaku K.K.). The obtained solution was subjected to repeated emulsifying steps five times by Eiger Motor Mill (made by Aiga Japan K.K.) at a frequency of 60 Hz. More specifically, as shown in FIG. 3, emulsion discharged from the discharging pipe 9 was further re-supplied into the casing through the pump 5, and circulated five times. The total time required for emulsification was approximately 1 minute. The same Eiger Motor Mill as used in Example I-1 was used. Thereafter, in the same manner as Example I-1, the solvent was removed, and the resulting product was cooled, subjected to filtration/washing with water several times, and then dried. Thus, toner particles were obtained.

COMPARATIVE EXAMPLE I-4

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K.K.) serving as a charge-control agent and 2 g of E-84 (made by Orient K.K.) . The resultant solution was put into a 2 liter polyethylene bin, mixed and dispersed by Ultra Turrax (made by IKA K.K.) for 30 minutes. Thus, a uniform toner composition solution ($\eta_A$=9.6) was prepared. The toner composition solution thus obtained was mixed into a dispersion solution ($\eta_B$=28.0) prepared by dissolving 0.01 g of alkyl diphenyl ether sodium disulfonate in 1,000g of a5.0 wt % aqueous solution of PVA PA-18 (made by Shinetsu Kagaku K.K.). The obtained solution was subjected to repeated emulsifying steps five times by Eiger Motor Mill (made by Aiga Japan K.K.) at a frequency of 40 Hz. More specifically, as shown in FIG. 3, emulsion discharged from the discharging pipe 9 was further re-supplied into the casing through the pump 5, and circulated five times. The total time required for emulsification was approximately 1 minute. The same Eiger Motor Mill as used in Example I-1 was used. Thereafter, in the same manner as Example I-1, the solvent was removed, and the resulting product was cooled, subjected to filtration/washing with water several times, and then dried. Thus, toner particles were obtained.

Evaluation

The viscosities $\eta_A$ and $\eta_B$ of the toner composition solution and the dispersion solution were measured in a Digital Leometer DV-1+(made by Brook Field K. K.). The volume-average particle size Dv and the number-average particle size Dp of toner particles obtained in the above-mentioned Examples and Comparative Examples were measured in a Coulter Counter (made by Coulter K.K.). The processing speed was calculated based upon the time required for emulsification and the throughput of the emulsifying process in each of Examples and Comparative Examples.

Results are presented in Table I-1.

TABLE I-1

| | $\eta_A$ (cP) | $\eta_B$ (cP) | $\eta_A/\eta_B$ | Processing speed (L/hr) | Dv ($\mu$m) | Dp ($\mu$m) | Dv/Dp | Frequency or number of revolutions of Eiger Moter Mill or Homomixer |
|---|---|---|---|---|---|---|---|---|
| Example I-1 | 9.6 | 8.8 | 1.1 | 90.0 | 5.8 | 4.5 | 1.3 | 50 Hz |
| Example I-2 | 32.0 | 28.0 | 1.1 | 60.0 | 6.2 | 4.8 | 1.3 | 60 Hz |
| Example I-3 | 9.6 | 18.5 | 0.5 | 90 | 6.0 | 4.7 | 1.3 | 40 Hz |
| Example I-4 | 17.5 | 8.8 | 2.0 | 72 | 6.1 | 4.8 | 1.3 | 60 Hz |
| Comparative Example I-1 | 9.6 | 8.8 | 1.1 | 9.0 | 6.1 | 4.0 | 1.5 | 4,000 rpm |
| Comparative Example I-2 | 32.0 | 28.0 | 1.1 | 6.0 | 6.0 | 3.8 | 1.6 | 5,000 rpm |
| Comparative Example I-3 | 20.0 | 8.8 | 2.3 | 66.6 | 7.5 | 4.1 | 1.8 | 60 Hz |
| Comparative Example I-4 | 9.6 | 28.0 | 0.3 | 90.0 | 7.2 | 4.0 | 1.8 | 40 Hz |

Table I-1 shows that in Examples I-1 and I-2, the processing speed is fast as compared with Comparative Examples I-1 and I-2 and the particle-size distribution is sharp (small in Dv/Dp) . In Comparative Examples I-3 and I-4, the particle-size distribution is broad (large in Dv/Dp). Consequently, as compared with emulsification made by a conventional mixer, the present process provides a faster processing speed and a sharper particle-size distribution when the collision shearing force of beads is utilized for emulsification according to the present invention. However, when the process is performed out of the range of $0.5 \leqq \eta_A/\eta_B \leqq 2$, the particle-size distribution becomes broader.

EXAMPLE II-1

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was pu in to a 2 liter polyethylene bin, mixed and dispersed by Ultra Turrax (made by IKA K.K.) for 30 minutes. Thus, a uniform toner composition solution ($\eta_A$=9.6) was prepared. The toner composition solution thus obtained was mixed into a dispersion solution ($\eta_B$=8.8) prepared by dissolving 0.01 g of alkyl diphenyl ether sodium disulfonate in 1,000 g of a 3.0wt % aqueous solution of PVA PA-18 (made by Shinetsu Kagaku K.K.). The obtained solution was subjected to repeated emulsifying steps five times by Mini- Colloider (made by SMT K.K.) at a frequency of 100 Hz. More specifically, as shown in FIG. 6, emulsion discharged from the outlet was further re-supplied into the casing through the pump, and circulated five times. The total time require for emulsification was approximately 1 minute. The Mini-Colloider used here had the number of revolutions of 6,000 rpm and a clearance space (value m) of 1.2 mm.

Thereafter, toluene was removed under conditions of 60° C. to65° C. and 140 mmHg to70 mmHg. The resultant mixture was cooled and subjected to filtration/washing with water several times. After washing, the resulting toner cake was transferred to a stainless vat, dried in a constant temperature drier at 35° C. for 48 hours, pulverized by a ball mill and filtered with a 90 $\mu$m-mesh filter to give toner particles.

EXAMPLE II-2

One hundred (100) g of low molecular weight polyester (Mw: 13,700, Mn:4,200, Tg: 60° C.) was dissolved in 230 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30minutes. Thus, a uniform toner composition solution ($\eta_A$=32.0) was prepared. The toner composition solution thus obtained was mixed into a dispersion solution ($\eta_B$=28.0) prepared by dissolving 0.007 g of alkyl diphenyl ether sodium disulfonate in 660 g of a 5.0 wt % aqueous solution of PVA PA-18 (made by Shinetsu Kagaku K.K.). The obtained solution was subjected to repeated emulsifying steps five times by Mini-Colloider (made by SMT K.K.) at a frequency of 117 Hz. More specifically, as shown in FIG. 6, emulsion discharged from the outlet was further re-supplied into the casing through the pump, and circulated five times. The total time required for emulsification was approximately 1 minute. The same Mini-Colloider as used in Example II-1 was used. Thereafter, in the same manner as Example II-1, the solvent was removed, and the resulting product was cooled, subjected to filtration/washing with water several times, and then dried. Thus, toner particles were obtained.

EXAMPLE II-3

One hundred (100) g of low molecular weight polyester (Mw: 13,700, Mn:4,200, Tg: 60° C.) was dissolved in 260 g of toluene, to this were added 6 g of a phthalocyanine pigment, 1 g of VP-434 (made by Hoechst K.K.) serving as a charge-control agent and 2 g of E-84 (made by Orient K.K.). The resultant solution was put into a 2 liter polyethylene bin, mixed and dispersed by Ultra Turrax (made by IKA K.K.) for 30 minutes. Thus, a uniform toner composition solution ($\eta_A$=29.2) was prepared. The toner composition solution thus obtained was mixed into a dispersion solution ($\eta_B$=18.5) prepared by dissolving 0.007 g of alkyl diphenyl ether sodium disulfonate in 720 g of a 4.0 wt % aqueous solution of PVA PA-18 (made by Shinetsu Kagaku K.K.). The obtained solution was subjected to repeated emulsifying steps five times by Mini-Colloider (made by SMT K.K.) at a frequency of 100 Hz. More specifically, as shown in FIG. 6, emulsion discharged from the outlet was further re-supplied into the casing through the pump, and circulated five times. The total time required for emulsification was approximately 1 minute. The same Mini-Colloider as used in Example I-1 was used. Thereafter, in the same manner as Example II-1, the solvent was removed, and the resulting product was cooled, subjected to filtration/washing with water several times, and then dried. Thus, toner particles were obtained.

EXAMPLE II-4

One hundred (100) g of low molecular weight polyester (Mw: 13,700, Mn:4,200, Tg: 60° C.) was dissolved in 330 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=15.8) was prepared. The toner composition solution thus obtained was mixed into a dispersion solution ($\eta_B$=18.5) prepared by dissolving 0.007 g of alkyl diphenyl ether sodium disulfonate in 660 g of a 4.0 wt % aqueous solution of PVA PA-18 (made by Shinetsu Kagaku K.K.). The obtained solution was subjected to repeated emulsifying steps five times by Mini-Colloider (made by SMT K.K.) at a frequency of 100 Hz. More specifically, as shown in FIG. 6, emulsion discharged from the outlet was further re-supplied into the casing through the pump, and circulated five times. The total time required for emulsification was approximately 1 minute. The same Mini-Colloider as used in Example II-1 was used. Thereafter, in the same manner as Example II-1, the solvent was removed, and the resulting product was cooled, subjected to filtration/washing several times, and then dried; thus, toner particles were obtained.

COMPARATIVE EXAMPLE II-1

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=9. 6) was prepared. The toner composition solution thus obtained was mixed into a dispersion solution ($\eta_B$=8.8) prepared by dissolving 0.01 g of alkyl diphenyl ether sodium disulfonate in 1,000 g of a 3.0 wt % aqueous solution of PVA PA-18 (made by Shinetsu Kagaku K.K.). The obtained mixture was emulsified by T.K Autohomomixer (made by Tokushukika Kogyo K.K.) at the number of revolutions of 4,000 rpm for 10 minutes. Thereafter, in the same manner as Example II-1, the solvent was removed, and the resulting product was cooled, subjected to filtration/washing with water several times, and then dried. Thus, toner particles were obtained.

COMPARATIVE EXAMPLE II-2

One hundred (100) g of low molecular weight polyester (Mw: 13,700, Mn:4,200, Tg: 60° C.) was dissolved in 230 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=32.0) was prepared. The toner composition solution thus obtained was mixed into a dispersion solution ($\eta_B$=28.0) prepared by dissolving 0.007 g of alkyl diphenyl ether sodium disulfonate in 660 g of a 5.0 wt % aqueous solution of PVA PA-18 (made by Shinetsu Kagaku K.K.). The obtained solution was emulsified by T.K Autohomomixer (made by Tokushukika Kogyo K.K.) at the number of revolutions of 5,000 rpm for 10 minutes. Thereafter, in the same manner as Example II-1, the solvent was removed, and the resulting product was cooled, subjected to filtration/washing with water several times, and then dried, Thus, toner particles were obtained.

COMPARATIVE EXAMPLE II-3

One hundred (100) g of low molecular weight polyester (Mw: 13,700, Mn:4,200, Tg: 60° C.) was dissolved in 300 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=15.8) was prepared. The toner composition solution thus obtained was mixed into a dispersion solution ($\eta_B$=8.8) prepared by dissolving 0.007 g of alkyl diphenyl ether sodium disulfonate in 660 g of a 3.0 wt % aqueous solution of PVA PA-18 (made by Shinetsu Kagaku K.K.). The obtained solution was subjected to repeated emulsifying steps five times by Mini-Colloider (made by SMT K.K.) at a frequency of 117 Hz. More specifically, as shown in FIG. 6, emulsion discharged from the outlet was further re-supplied into the casing through the pump, and circulated five times. The total time required for emulsification was approximately 1 minute. The same Mini-Colloider as used in Example II-1 was used. Thereafter, in the same manner as Example II-1, the solvent was removed, and the resulting product was cooled, subjected to filtration/washing with water several times, and then dried; thus, toner particles were obtained.

COMPARATIVE EXAMPLE II-4

One hundred (100) g of low molecular weight polyester (Mw: 13,700, Mn:4,200, Tg: 60° C.) was dissolved in 400 g of toluene, to this were added 6 g of a phthalocyanine pigment, 1 g of VP-434 (made by Hoechst K.K.) serving as a charge-control agent and 2 g of E-84 (made by Orient K.K.). The resultant mixture was put into a 2 liter polyethylene bin, mixed and dispersed by Ultra Turrax (made by IKA K.K.) for 30 minutes. Thus, a uniform toner composition solution ($\eta_A$=9.6) was prepared. The toner composition solution thus obtained was mixed into a dispersion solution ($\eta_B$=18.5) prepared by dissolving 0.01 g of alkyl diphenyl ether sodium disulfonate in 1,000 g of a 4.0 wt % aqueous solution of PVA PA-18 (made by Shinetsu Kagaku K.K.). The obtained solution was subjected to repeated emulsifying steps five times by Mini-Colloider (made by SMT K.K.) at a frequency of 100 Hz. More specifically, as shown in FIG. 6, emulsion discharged from the outlet was further re-supplied into the casing through the pump, and circulated five times. The total time required for emulsification was approximately 1 minute. The same Mini-Colloider as used in Example II-1 was used. Thereafter, in the same manner as Example II-1, the solvent was removed, and the resulting product was cooled, subjected to filtration/washing with water several times, and then dried. Thus, toner particles were obtained.

Evaluation

The viscosities $\eta_A$ and $\eta_B$ of the toner composition solution and the dispersion solution were measured in a Digital Leometer DV-1+ (made by Brook Field K. K.). The volume-average particle size Dv and the number-average particle size Dp of toner particles obtained by the above-mentioned Examples and Comparative Examples were measured in a Coulter Counter (made by Coulter Co., Ltd.). Furthermore, the processing speed was calculated based upon the time required for emulsification and the throughput of the emulsifying process in each of Examples and Comparative Examples.

Results are presented in Table II-1.

TABLE II-1

| | $\eta_A$ (cP) | $\eta_B$ (cP) | $\eta_A/\eta_B$ | Processing speed (L/hr) | Dv ($\mu$m) | Dp ($\mu$m) | Dv/Dp |
|---|---|---|---|---|---|---|---|
| Example II-1 | 9.6 | 8.8 | 1.1 | 90.0 | 5.8 | 4.6 | 1.3 |
| Example II-2 | 32.0 | 28.0 | 1.1 | 60.0 | 5.3 | 4.1 | 1.3 |
| Example II-3 | 29.2 | 18.5 | 1.6 | 64.8 | 6.8 | 5.1 | 1.3 |
| Example II-4 | 15.8 | 18.5 | 0.9 | 65.4 | 6.4 | 4.8 | 1.3 |
| Comparative Example II-1 | 9.6 | 8.8 | 1.1 | 9.0 | 6.1 | 4.0 | 1.5 |
| Comparative Example II-2 | 32.0 | 28.0 | 1.1 | 6.0 | 6.0 | 3.8 | 1.6 |
| Comparative Example II-3 | 15.8 | 8.8 | 1.8 | 65.4 | 7.8 | 4.3 | 1.8 |
| Comparative Example II-4 | 9.6 | 18.5 | 0.5 | 90.0 | 7.5 | 4.2 | 1.8 |

Table II-1 shows that in Examples II-i and II-2, the processing speed is fast as compared with Comparative Examples II-1 and II-2 and the particle-size distribution is sharp (small in Dv/Dp). In Comparative Examples II-3 and II-4, the particle-size distribution is broad (large in Dv/Dp). Consequently, as compared with emulsification made by a conventional mixer, the present process provides a faster processing speed and a sharper particle-size distribution when the colloid mill method is adopted according to the present invention. However, the process is performed out of the range of $0.8 \leqq \eta_A/\eta_B \leqq 1.6$, the particle-size distribution becomes broader.

What is claimed is:

1. A process for preparing a toner, comprising the steps of:

providing a toner composition solution by mixing a binder resin, a colorant, a charge-control agent and an organic solvent;

mixing the resulting toner composition solution with a dispersion solution containing a dispersing agent under a collision shearing force caused by beads to give an O/W type emulsion;

heating the resulting emulsion so as to eliminate said organic solvent; and obtaining a toner by washing and drying resulting particles, the relationship between a viscosity $\eta_A$ of the toner composition solution and a viscosity $\eta_B$ of the dispersion solution satisfying the following inequality: $0.5 \leqq \eta_A/\eta_B \leqq 2$.

2. The process of claim 1, wherein the viscosity $\eta_A$ of the toner composition solution is set in a range of not less than 5 cP to not more than 50 cP and the viscosity $\eta_B$ of the dispersion solution is set in a range of not less than 1.5 cP to not more than 50 cP.

3. The process of claim 2, wherein the viscosity $\eta_A$ of the toner composition solution is set in a range of not less than 7 cP to not more than 40 cP.

4. The process of claim 2, wherein the viscosity $\eta_B$ of the dispersion solution is set in a range of not less than 3 cP to not more than 40 cP.

5. The process of claim 1, wherein, supposing that said toner composition solution has a weight $W_A$ and said dispersion solution has a weight $W_B$, a ratio $W_A/W_B$ is set in a range of not less than 0.3 to not more than 1.

6. The process of claim 1, wherein said toner particles have a volume-average particle size (Dv) ranging from 1 to 10 $\mu$m and a ratio of Dv/Dp is not more than 1.4 wherein Dp represents a number-average particle size.

7. The process of claim 1, wherein said toner particles have a volume-average particle size (Dv) ranging from 3 to 7 $\mu$m and a ratio of Dv/Dp is not more than 1.3 wherein Dp represents a number-average particle size.

8. The process of claim 1, wherein said beads have a diameter ranging from 0.05 to 10 mm.

9. The process of claim 1, wherein said step of obtaining the O/W type emulsion is carried out by adding said toner composition solution to said dispersion solution so as to be emulsified.

10. The process of claim 1, wherein said step of obtaining the O/W type emulsion is carried out by adding said dispersion solution to said toner composition solution so as to be subjected to a phase-inversion for emulsification.

11. A process for preparing a toner, comprising the steps of:

providing a toner composition solution by mixing a binder resin, a colorant, a charge-control agent and an organic solvent;

mixing the resulting toner composition solution with a dispersion solution containing a dispersing agent by using a colloid mill to give an O/W type emulsion;

heating the resulting emulsion so as to eliminate said organic solvent; and obtaining a toner by washing and drying resulting particles, the relationship between a viscosity $\eta_A$ of the toner composition solution and a viscosity $\eta_B$ of the dispersion solution satisfying the following inequality: $0.8 \leqq \eta_A/\eta_B \leqq 1.6$.

12. The process of claim 11, wherein the viscosity $\eta_A$ of the toner composition solution is set in a range of not less than 5 cP to not more than 50 cP and the viscosity $\eta_B$ of the dispersion solution is set in a range of not less than 1.5 cP to not more than 50 cP.

13. The process of claim 12, wherein the viscosity $\eta_A$ of the toner composition solution is set in a range of not less than 7 cP to not more than 40 cP.

14. The process of claim 12, wherein the viscosity $\eta_B$ of the dispersion solution is set in a range of not less than 3 cP to not more than 40 cP.

15. The process of claim 11, wherein, supposing that said toner composition solution has a weight $W_A$ and said dispersion solution has a weight $W_B$, a ratio $W_A/W_B$ is set in a range of not less than 0.3 to not more than 1.

16. The process of claim 11, wherein said toner particles have a volume-average particle size (Dv) ranging from 1 to 10 $\mu$m and a ratio of Dv/Dp is not more than 1.4 wherein Dp represents a number-average particle size.

17. The process of claim 11, wherein said toner particles have a volume-average particle size (Dv) ranging from 3 to 7 $\mu$m and a ratio of Dv/Dp is not more than 1.3 wherein Dp represents a number-average particle size.

18. The process of claim 11, wherein said step of obtaining the O/W type emulsion is carried out by adding said toner composition solution to said dispersion solution so as to be emulsified.

19. The process of claim 11, wherein said step of obtaining the O/W type emulsion is carried out by adding said dispersion solution to said toner composition solution so as to be subjected to a phase-inversion for emulsification.

20. The process of claim 11, wherein said colloid mill is provided with a rotor and stator, the rotor is set to a rotational speed ranging from 3,000 to 8,000 rpm, a clearance between the rotor and the stator is set to the range between 0.3 and 3 mm.

* * * * *